United States Patent [19]

McGarry et al.

[11] Patent Number: 4,583,990

[45] Date of Patent: Apr. 22, 1986

[54] METHOD FOR THE BENEFICIATION OF LOW RANK COAL

[75] Inventors: Phillip E. McGarry, Palmerton; David E. Herman, Jim Thorpe, both of Pa.

[73] Assignee: The Standard Oil Company, Cleveland, Ohio

[21] Appl. No.: 510,994

[22] Filed: Jul. 5, 1983

Related U.S. Application Data

[63] Continuation of Ser. No. 230,060, Jan. 29, 1981, abandoned.

[51] Int. Cl.[4] ..... C10L 1/32

[52] U.S. Cl. ..... 44/51; 44/1 R; 44/1 SR; 44/62; 44/66; 44/68; 208/8 R; 208/9; 208/10

[58] Field of Search ..... 44/1 R, 1 SR, 51, 62, 44/66, 68; 209/9, 166, 171, 173, 176; 208/8–10; 252/61

[56] References Cited

U.S. PATENT DOCUMENTS

| | | | |
|---|---|---|---|
| 1,390,230 | 9/1921 | Bates | 44/51 |
| 2,074,699 | 1/1937 | Lenher et al. | 209/166 |
| 2,397,859 | 4/1946 | Hersberger et al. | 44/51 |
| 2,671,758 | 3/1954 | Vinograd et al. | 252/18 |
| 2,684,338 | 7/1954 | McGowan et al. | 252/311.5 |
| 2,740,522 | 4/1956 | Aimone et al. | 209/166 |
| 3,107,214 | 10/1963 | Metuchen | 209/166 |
| 3,244,615 | 4/1966 | Huntington | 208/97 |
| 3,376,168 | 4/1968 | Horowitz | 429/144 |
| 3,401,049 | 10/1968 | Horowitz | 427/302 |
| 3,698,931 | 10/1972 | Horowitz | 427/399 |
| 3,703,481 | 11/1972 | Barker et al. | 252/546 |
| 3,732,084 | 5/1973 | Nixon et al. | 44/51 |
| 3,784,464 | 1/1974 | Kaminsky | 209/173 |
| 3,880,580 | 4/1975 | Horowitz et al. | 427/304 |
| 4,033,852 | 7/1977 | Horowitz et al. | 44/1 R |
| 4,080,176 | 3/1978 | Verschuur | 44/1 SR |
| 4,101,293 | 7/1978 | Krause et al. | 44/51 |
| 4,158,548 | 6/1979 | Burk et al. | 44/1 R |
| 4,163,644 | 8/1979 | Bowers | 44/51 |
| 4,196,092 | 4/1980 | Wang et al. | 252/61 |
| 4,201,552 | 5/1980 | Rowell | 44/51 |
| 4,217,109 | 8/1980 | Siwerson et al. | 44/1 SR |
| 4,227,994 | 12/1980 | Knebel et al. | 208/177 |
| 4,244,699 | 1/1981 | Smith et al. | 209/172 |
| 4,248,698 | 2/1981 | Keller | 44/1 SR |
| 4,249,699 | 2/1981 | Smith et al. | 209/172 |
| 4,251,229 | 2/1981 | Joyo et al. | 44/51 |
| 4,252,540 | 2/1981 | Yamamura et al. | 44/51 |
| 4,252,639 | 2/1981 | Smith et al. | 209/172 |
| 4,253,944 | 3/1981 | Hefner | 209/166 |
| 4,255,155 | 3/1981 | Frankovich | 44/1 SR |
| 4,255,156 | 3/1981 | Sun et al. | 44/1 SR |
| 4,261,699 | 4/1981 | Sun et al. | 44/1 SR |
| 4,270,926 | 6/1981 | Burk et al. | 44/1 SR |
| 4,282,004 | 8/1981 | Masologites | 44/1 SR |
| 4,304,573 | 12/1981 | Burgess et al. | 44/68 |
| 4,306,883 | 12/1981 | Eckman | 44/68 |
| 4,332,593 | 6/1982 | Burgess et al. | 44/51 |

FOREIGN PATENT DOCUMENTS

| | | | |
|---|---|---|---|
| 0169776 | 9/1921 | United Kingdom | 209/173 |
| 1523193 | 8/1978 | United Kingdom | 44/51 |

OTHER PUBLICATIONS

Fuel Extension by Dispersion of Clean Coal in Oil--Government Report #FE-2694.

Feasibility Study of Molecular Grafting to Solubilize Coal-Government Report #FE-2020-1.

Cleaning of Eastern Bituminous Coal by the Grinding Froth Flotation and High Gradient Magnetic Separation-Sep. 1978, presented at EPA Symposium on Coal Cleaning to Achieve Energy and Environmental Goals, Hollywood, Florida.

Encyclopedia of Chemical Technology, Kirk-Othmer (1980), vol. 11, pp. 401–422, and 449–473.

Encyclopedia Chemical Technology, Kirk-Othmer (1980), vol. 6, pp. 314–322.

*Primary Examiner*—William R. Dixon, Jr.
*Assistant Examiner*—Margaret B. Medley
*Attorney, Agent, or Firm*—Bruce E. Harang; David J. Untener; Larry W. Evans

[57] ABSTRACT

Process for the beneficiation and recovery of low rank coals comprising subjecting pulverized low rank coal to surface treatment by admixing said coal with an aqueous mixture comprised of a polymerizable monomer, a polymerization catalyst and a coal derived oil; and the beneficiated low ash, low sulfur containing product resulting therefrom.

19 Claims, No Drawings

METHOD FOR THE BENEFICIATION OF LOW RANK COAL

This application is a continuation of application Ser. No. 230,060, filed Jan. 29, 1981 and now abandoned.

BACKGROUND OF THE INVENTION

This invention relates to a process for the beneficiation of solid carbonaceous fuel materials and more particularly to a process for the beneficiation of low rank coals.

Known resources of coal and other solid carbonaceous fuel materials are far greater than the known resources of petroleum and natural gas combined. Despite this enormous abundance of coal and related solid carbonaceous materials, reliance on these resources, particularly coal, as primary sources of energy, has been, for the most part, discouraged. The availability of cheaper, cleaner burning, more easily retrievable and transportable fuels, such as petroleum and natural gas, has, in the past, cast coal to a largely supporting role in the energy field.

Current world events, however, have forced a new awareness of global energy requirements and of the availability of those resources which will adequately meet these needs. The realization that reserves of petroleum and natural gas are being rapidly depleted in conjunction with skyrocketing petroleum and natural gas prices and the unrest in the regions of the world which contain the largest quantities of these resources, has sparked a new interest in the utilization of solid carbonaceous materials, particularly coal, as primary energy sources.

As a result, enormous efforts are being extended to make coal and related solid carbonaceous materials equivalent or better sources of energy, than petroleum or natural gas. In the case of coal, for example, much of this effort is directed to overcome the environmental problems associated with its production, transportation and combustion. For example, health and safety hazards associated with coal mining have been significantly reduced with the onset of new legislation governing coal mining. Furthermore, numerous techniques have been explored and developed to make coal cleaner burning, more suitable for burning and more readily transportable.

Gasification and liquefaction of coal are two such known techniques. Detailed descriptions of various coal gasification and liquification processes may be found, for example, in the *Encyclopedia of Chemical Technology,* Kirk-Othmer, Third Edition (1980) Volume 11, pages 410–422 and 449–473. Typically these techniques, however, require high energy input, as well as the utilization of high temperature and high pressure equipment, thereby reducing their widespread feasibility and value.

Processes to make coal more readily liquefiable have also been developed. One such process is disclosed in U.S. Pat. No. 4,033,852 (Horowitz, et al). This process involves chemically modifying the surface of the coal, the effect of which renders a portion of the coal more readily liquefiable than the natural forms of coal.

In addition to gasification and liquefaction, other methods for converting coal to more convenient forms for burning and transporting are also known. For example, the preparation of coal-oil and coal-aqueous mixtures are described in the literature. Such liquid coal mixtures offer considerable advantages. In addition to being more readily transportable than solid dry coal, they are more easily storable, and less subject to the risks of explosion by spontaneous ignition. Moreover, providing coal in a fluid form makes it feasible for burning in conventional apparatus used for burning fuel oil. Such a capability can greatly facilitate the transition from fuel oil to coal as a primary energy source. Typically, coal-oil and coal-aqueous mixtures and their preparation are disclosed in U.S. Pat. No. 3,762,887, U.S. Pat. No. 3,617,095 and U.S. Pat. No. 4,217,109 and British Patent No. 1,523,193.

Regardless of the form in which the coal is ultimately employed, the coal must be cleaned because it contains substantial amounts of sulfur, nitrogen compounds, and mineral matter, including significant quantities of metal impurities. During combustion these materials enter the environment as sulfur dioxides, nitrogen oxides and compounds of metal impurities. If coal is to be accepted as a primary energy source, it must be cleaned to prevent pollution of the environment, either by cleaning the combustion products or the coal prior to burning.

Accordingly, physical, as well as chemical, coal cleaning (beneficiation) processes have been extensively explored. In general, physical coal cleaning processes involve grinding the coal to release the impurities, wherein the fineness of the coal generally governs the degree to which the impurities are released. However, because the costs of preparing the coal rise exponentially with the amount of fines, there is an economic optimum in size reduction. Moreover, grinding coal even to the finest sizes is not effective in removing all impurities.

Based on the physical properties that effect the separation of the coal from the impurities, physical coal cleaning methods are divided into four general categories: gravity, flotation, magnetic and electrical methods.

In contrast to physical coal cleaning, chemical coal cleaning techniques are in a very early stage of development. Known chemical coal cleaning techniques include, for example, oxidative desulfurization of coal (sulfur is converted to a water-soluble form by air oxidation), ferric salt leaching (oxidation of pyritic sulfur with ferric sulfate), and hydrogen peroxide-sulfuric acid leaching. Other methods are disclosed in the above-noted reference to the *Encyclopedia of Chemical Technology,* Volume 6, pages 314–322.

A recent promising development in the art of chemical coal beneficiation is disclosed in copending U.S. patent applications Ser. Nos. 114,357 and 114,414, each filed Jan. 22, 1980 and in United States Government Report No. 2694 entitled "Fuel Extension by Dispersion of Clean Coal in Fuel Oil" all incorporated herein by reference. In summary, according to this coal beneficiation process, coal is first cleaned of rock and the like and pulverized to a fine size. The pulverized coal, now in the form of a water slurry, is then contacted with a mixture comprising a polymerizable monomer, polymerization catalysts and fuel oil. The resultant surface treated coal is highly hydrophobic and oleophilic and is thus readily separated from unwanted ash and sulfur using oil and water separation techniques. Moreover, the hydrophobic coal can be readily further dehydrated to very low water levels without employing costly thermal energy. The clean, very low moisture content coal, resulting from this process can then be employed as is, i.e., a dry solid product, or used to form advantageous coal-oil or coal-aqueous mixtures.

However, as a result of the variant chemical make-up of the known classes of coal, e.g., lignite, anthracite, bituminous, etc., each class responds differently to beneficiation. The so-called low rank coals, i.e. low rank bituminous, sub-bituminous, lignite and peat, contain water of hydration, which impairs and at times prevents, beneficiation by conventional froth flotation processes. For example, these coals do not respond to conventional oil agglomeration, nor do they respond satisfactorily to the socalled Otiska process. Accordingly, the yields from these processes are very poor. While these low rank coals may be beneficiated according to the process disclosed in said copending U.S. application Ser. Nos. 114,357 and 114,414, the results achieved employing this process have not be entirely satisfactory, either.

Since the total resources of low rank coals represent a highly significant portion of the total coal supply, an improved process for beneficiating these forms of coal is much desired.

SUMMARY OF THE INVENTION

Accordingly, it is one object of the present invention to provide an improved process for the beneficiation of low rank coal.

It is another object of the present invention to provide a process for the beneficiation of low rank coal which provides a beneficiated product having a low moisture, ash and sulfur content.

Still another object of this invention is to provide a process for the beneficiation of low rank coal which provides a beneficiated product which is highly suitable for forming coal-aqueous and coal-oil mixtures.

A still further object of the present invention is to provide a process for the beneficiation of low rank coal which results in a high recovery of beneficiated product.

These and other objects are accomplished herein by a process comprising the steps of:

(a) admixing pulverized low rank coal with a coal derived oil and a surface treating mixture comprising water, a polymerizable monomer and a catalyst; and (b) recovering the resultant beneficiated surface treated coal product.

DETAILED DESCRIPTION OF THE INVENTION

In copending U.S. applications Ser. Nos. 114,357 (U.S. Pat. No. 4,332,593) and 114,414 (U.S. Pat. No. 4,304,573), each filed Jan. 22, 1980 and each incorporated herein by reference, a coal beneficiation process is disclosed wherein an aqueous pulverized coal slurry is admixed and surface treated with a mixture comprising a polymerizable monomer, a polymerization catalyst and a minor amount of fuel oil. While it is not completely understood and while not wishing to be bound by theory, it is believed that this surface treatment involves the formation of a polymeric organic coating on the surface of the coal by molecular grafting of polymeric side chains on the coal molecules.

It has now been surprisingly discovered that if coal derived oils, also known as coal tar oils and/or coal tar derivatives, are employed in lieu of or in combination with the fuel oil or other liquid organic carriers generally used in the beneficiation processes described above, improved beneficiation results are achieved with low rank coals. Again, while not wishing to be bound by theory, it is believed that the admixture of these low rank coals with a coal derived oil breaks down and releases the water of hydration contained in these low rank coals, particularly lignite and sub-bituminous coal. By so doing, the coal is rendered more hydrophobic and oleophilic and accordingly more readily beneficiated.

Moreover, it is believed that the surface treatment according to this invention also involves the formation of a polymeric coating on the surface of the coal by molecular grafting of polymeric side chains on the coal molecules.

Thus, in the practice of the present invention, it is initially preferred to reduce raw mined low rank coal to a fine diameter size and to remove the unwanted rock, heavy ash and the like materials collected in the mining operation. Usually, the raw coal is crushed and ground in the presence of water, employing conventional equipment such as, for example, ball or rod mills, breakers and the like.

It is generally desirable, although, not necessary to employ certain water conditioning or treating additives in the pulverization operation. These additives assist in rendering the ash more hydrophilic which facilitates the separation thereof. Typically, these additives can include conventional inorganic and organic dispersants, surfactants and/or wetting agents. Preferred additives for this purpose include sodium carbonate,sodium pyrophosphate, and the like.

The coal-aqueous slurry formed by the heretofore pulverization operation is typically one having a coal to water ratio of about 1:3 parts by weight, respectively. If utilized, the water conditioning additives hereinbefore described are employed in small amounts, usually, for example, from about 0.25% to about 5% based on the weight of dry coal. While it is generally recognized that more impurities are liberated as the size of the coal is reduced, the law of diminishing returns is applicable in that there is an economic optimum which governs the degree of pulverization. In any event, for the purposes of this invention, it is generally desired to crush the coal to a particle size of from about 48 to about 300 mesh, preferably about 80% of the particles being of about a 200 mesh size.

The pulverized coal-aqueous slurry is then contacted and admixed with a surface treating mixture comprising a coal derived oil, a polymerizable monomer, a polymerization catalyst and optionally, a further organic liquid carrier, such as fuel oil. For the purposes of this invention, the coal derived oil may be admixed with the coal before or in combination with or after the remaining surface treating ingredients are contacted and admixed with the coal.

In practice of this invention, the coal is admixed with the surface treating admixture, including the coal derived oil under any polymerization conditions, for example, temperatures ranging from about 20° to about 70° C. at atmospheric or nearly atmospheric conditions for from about 1 second to about 30 minutes, preferably from about 1 second to about 3 minutes. The resultant surface treated coal is extremely hydrophobic and oleophilic and thus a coal froth phase ensues which is readily removed from the remaining aqueous ash containing phase.

Any polymerizable monomer can be employed in the polymerization reaction medium herein. While it is more convenient to utilize monomers which are liquid at ambient temperature and pressure, gaseous monomers which contain olefinic unsaturation permitting polymerization with the same or different molecules can also be used. Thus, monomers intended to be employed herein may be characterized by the formula XHC=CHX' wherein X and X' each may be hydrogen or any of a wide variety of organic radicals or inorganic substituents. Illustratively, such monomers include ethylene, propylene, butylene, tetrapropylene, isoprene, butadiene, such as 1,4-butadiene, pentadiene, dicyclopentadiene, octadiene, olefinic petroleum fractions, sytrene, vinyltoluene, vinylchloride, vinylbromide, acrylonitrile, methacrylonitrile, acrylamide, methacrylamide, N-methylolacrylamide, acrolein, maleic acid, maleic acid, maleic anhydride, fumaric acid, abietic acid and the like.

A preferred class of monomers for the purposes of the present invention are unsaturated carboxylic acids, esters, or salts thereof, particularly, those included within the formula $$RC(=O)-OR'$$

wherein R is an olefinically unsaturated organic radical, preferably containing from about 2 to about 30 carbon atoms, and R' is hydrogen, a salt-forming cation such as an alkali metal, alkaline earth metal or ammonium cation, or a saturated or ethylenically unsaturated hydrocarbyl radical, preferably containing from 1 to about 30 carbon atoms, either unsubstituted or substituted with one or more halogen atoms, carboxylic acid groups and/or hydroxyl groups in which the hydroxyl hydrogens may be replaced with saturated and/or unsaturated acyl groups, the latter preferably containing from about 8 to about 30 carbon atoms. Specific monomers conforming to the foregoing structural formula include unsaturated fatty acids such as oleic acid, linoleic acid, linolenic, ricinoleic, mono-, di-, and triglycerides, and other esters of unsaturated fatty acids, acrylic acid, methacrylic acid, methylacrylate, ethylacrylate, ethylhexylacrylate, tertiarybutyl acrylate, oleylacrylate, methylmethacrylate, oleylmethacrylate, stearylacrylate, stearylmethacrylate, laurylmethacrylate, vinylstearate, vinylmyristate, vinyllaurate, soybean oil, dehydrated castor oil, tall oil, corn oil and the like. For the purposes of this invention, tall oil and corn oil have been found to provide particularly advantageous results. Corn oil is especially preferred. Thus, it is clearly understood that compositions containing compounds within the foregoing formula and in addition containing, for example, saturated fatty acids, such as palmitic, stearic, etc. are also contemplated herein.

The amount of polymerizable monomer will vary depending upon the results desired. In general, however, monomer amounts of from about 0.005% to about 1.0% by weight, preferably from 0.02 to 0.1 percent by weight of the dry coal are used.

The catalysts employed in the coal surface treating beneficiation reaction of the present invention are any such materials commonly used in polymerization reactions. Typically, for the purposes of this invention, any catalytic amount of those catalysts, which are commonly referred to as free radical catalysts or catalyst system (which can also be referred to as addition polymerization catalysts, vinyl polymerization catalysts or polymerization initiators) are preferred. Thus, illustratively, catalysts contemplated herein include benzoyl peroxide, methylethyl ketone peroxide, tert-butylhydroperoxide, hydrogen peroxide, ammonium persulfate, di-tert-butylperoxide, tert-butylperbenzoate, peracetic acid and including such non-peroxy free radical initiators as the diazo compounds, such as 1,1'bis-azoisobutyronitrile, and the like.

Moreover, free radical polymerization systems commonly employ free radical initiators which funiction to help initiate the free radical reaction. For the purposes herein, any of those disclosed in the prior art may be used. Specifically, some of these initiators include, for example, sodium perchlorate and perborate, sodium persulfate, potassium persulfate, ammonium persulfate, silver nitrate, water soluble salts of noble metals such as platinum and gold, water soluble salts of iron, zinc, arsenic, antimony, tin, cadmium and mixtures thereof. Particularly preferred initiators herein are the water soluble copper salts, i.e. cuprous and cupric salts, such as copper acetate, copper sulfate and copper nitrate. Most advantageous results have been obtained herein with cupric nitrate, $Cu(NO_3)_2$. Further initiators contemplated plated herein are, also disclosed in U.S. patent application Ser. No. 230,063 filed concurrently herewith and incorporated herein by reference. These initiators include metal salts of naphthenates, tallates, octanoates, etc., said metals including copper, cobalt, manganese, nickel, tin, lead, zinc, iron, rare earth metals, mixed rare earths and mixtures thereof. The amounts of catalysts contemplated herein include any catalytic amount and generally are within the range of from about 10–1000 ppm (parts per million), of the metal portion of the initiator, preferably 10–200 ppm, based on the amount of dry coal.

As indicated hereinbefore, the advantages of the present invention are derived principally from the utilization of coal derived oil, i.e. coal tar or coal tar derivative, in the beneficiation process.

The coal derived oils contemplated for use in the process of this invention are those liquid products which result from the dry distillation or carbonization (coking) of coal and which, generally, are products having a boiling point in the range of from about 100°–500° C. That is, the dry distillation or carbonization of coal yields a liquid condensate, most of which is coal tar. While crude coal tar may be employed herein as a coal derived oil it is preferred to employ coal tar derivatives which are commercially provided by the distillation or topping of the crude coal tar. The distillate from this procedure, i.e. chemical oil, generally has an upper boiling point of about 250° C. and contains:

(1) phenols, cresols, xylenols, (tar acids) (The tar acids, customarily constitute about 15 to 30% of the coal tar).

(2) naphthalene (the most prevalent single constituent of coal tar, usually 6–10%), and (3) pyridine-type and primary bases, such as quinoline, isoquinoline, picolines, lutidines, quinaldine, etc. (tar bases). Accordingly, this distillate or any of the components thereof are within the scope of the coal derived oils which may be employed in the process of this invention. Moreover, the higher boiling more viscous tar constituents residue from the distillation of the crude tar may also be employed for the purposes of this invention. Thus, coal derived oils contemplated in the practice of this invention include, for example, commercially available crude coal tar, tar acids, tar bases, naphtha, topped tar (the residue from crude tar distillation), creosote, pitch and the like.

Generally, the amount of coal derived oil used in the present process is small and is, for example, from about 0.5% to about 5%, preferably about 2–3% by weight of the amount of dry coal. If the coal derived oil is employed in conjunction with a further liquid organic carrier such as fuel oil, like No. 2 fuel oil, the amount of coal derived oil may be less, wherein the total content of coal derived oil and fuel oil employed is preferably about 2.5% by weight based on the amount of dry coal.

After admixture and reaction with the surface treating composition, i.e., the mixture of coal derived oil, polymerizable monomer and catalyst, the resulting low rank coal is, in contrast to prior art processes, extremely hydrophobic and oleophilic and consequently, readily floats and separates from the aqueous phase. The floating hydrophobic oleophilic coal is thusly readily removed from the aqueous phase, for example, by skimming, and is thereafter, if desired, readily introduced for further treatment, e.g. dried and used as is, or further washed and/or surface treated, or admixed with oil or water in the preparation of desirable coal-oil or coal-aqueous mixtures.

As indicated hereinbefore, the surface treating reaction mixture of the present invention may also optionally include an additional liquid organic carrier. This liquid organic carrier is utilized to further facilitate contact of the surface of the coal particles with the polymerization reaction medium. Thus, optional liquid organic carriers included within the scope of this invention are, for example, fuel oil, such as No. 2 or No. 6 fuel oils, other hydrocarbons including benzene, toluene, xylene, hydrocarbons fractions such as naphtha and medium boiling petroleum fractions (boiling point 100°–180° C.), dimethylformamide, tetrahydrofuran, tetrahydrofurfuryl alcohol, dimethylsulfoxide, methanol, ethanol, isopropyl alcohol, acetone, methylethyl ketone, ethyl acetate and the like and mixtures thereof. For the purposes of this invention, fuel oil is a preferred optional carrier.

If used, the amounts of optional liquid organic carrier, such as fuel oil, contemplated herein are generally in the range of from about 0.5 to about 5% by weight of dry coal.

Water is a further ingredient which is utilized in the surface treatment reaction mixture of the present process. Amounts of water contemplated for this purpose are from about 65% to about 95% by weight of the amount of dry coal.

The low rank coal resulting from the beneficiation process of this invention is very low in ash, sulfur and moisture content. Typically, the beneficiated low rank coal prepared by the process of the present invention has an ash content of from 5 to about 10%, a sulfur content of from about 0.5 to about 1.0% and a moisture content of from about 15 to about 30%, based on the dry coal weight. Moreover, recovery of beneficiated product in accordance with the present invention is also very good and is generally from about 50% to about 60%.

The process of this invention can be carried out as described herein and also in any of the process modes described in heretofore mentioned U.S. applications Ser. Nos. 114,357 and 114,414. Moreover, the present process is easily adapted to the process described in U.S. application, Ser. No. 230,056 filed concurrently herewith, and incorporated herein by reference, disclosing and claiming a desirable, continuous and integrated process for the beneficiation and high recovery of coal.

In addition, a particularly effective technique for separating the treated coal particles from unwanted ash and sulfur in the water phase is an aeration spray technique wherein a coal froth phase is formed by spraying or injecting the treated coal-water slurry into the surface of cleaning water as os described and claimed in U.S. patent application Ser. No. 230,058 now U.S. Pat. No. 4,347,126 and Ser. No. 230,059, now U.S. Pat. No. 4,347,127 filed concurrently herewith and incorporated herein by reference. Briefly, according to the method and apparatus there described the coal slurry is injected through at least one spray nozzle at pressures, for example, at from about 15–20 psi at a spaced-apart distance above the water surface into the water surface producing aeration and a frothing or foaming of the coal particles, causing these particles to float to the water surface for skimming off.

It is contemplated herein that the coal froth phase which results from the initial surface treating step, as hereinbefore described, may be further washed and/or surface treated by admixing the same with a further aqueous medium which can comprise simply clean water or water and water conditioning agents or water and any or all of the ingredients which comprise the initial surface treating admixture, including the coal derived oil. Moreover, any number of these additional washings and/or surface treatments may be utilized for the purposes of this invention before recovering the beneficiated coal product. Furthermore, it is within the scope of this invention to similarly process the aqueous phases which are concomitantly formed along with the coal froth phases produced in accordance with the process of this invention. Thus, these aqueous phases may be surface treated and/or washed as hereinbefore described and the residual beneficiated coal may be recovered for increased yields.

In order that those skilled in the art may better understand how the present invention is practiced, the following examples are presented by way of illustration and not by way of limitation.

EXAMPLE 1

200 grams of Indianhead lignite coal having an initial ash and sulfur content of 9.77% and 1.00%, respectively, are crushed to a 28 mesh size and pulverized for 15 minutes in a steel ball mill in the presence of 500 grams of water. The pulverized coal-aqueous slurry is added to a vessel to which the following reagents are added and admixed: 10 ml. $Na_4P_2O_7$ (50 mg./ml.), 1 cc. $H_2O_2$ (5%) 2 ml. cupric nitrate (50 mg/ml), 50 mg. corn oil, 10 gms. FLOTATION Oil No. 634 (a coal derived oil, commercially available Allied Chemical Company), 8 ml. Aerofroth-65 (5 mg/ml) (a propylene oxide reaction product with ethylene glycol mol. wt. 400–450, available from American Cynamid Company) and 1 cc. pine oil. The resultant admixture is permitted to react at 30° C. and atmospheric pressure for about 5 minutes. The ensuing coal froth phase is separated and introduced to another vessel containing an aqueous medium comprising 500 grams of clean water. The resultant coal froth phase therein is again removed and introduced to a second aqueous medium comprising 500 grams of clean water. The coal froth phase is removed and the beneficiated coal is recovered. The product is found to have a reduced ash content of 6.22% and a reduced sulfur content of 0.76%. The % recovery is excellent and is determined to be 58.3%.

In this example, and the examples which follow, the pine oil and Aerofroth-65 are employed as frothing aids. The use of these and other frothing agents in processes similar to that disclosed herein is disclosed and claimed in U.S. patent application Ser. No. 230,061 filed concurrently herewith.

EXAMPLE 2

200 grams of Indianhead lignite coal having an initial ash and sulfur content of 11.9% and 0.91%, respectively, is crushed and pulverized in the presence of 500 grams of water to a 200 mesh size. The coal-aqueous slurry is placed in a separatory funnel containing 5000 grams of water at 30° C. The slurry is agitated and 0.5 gms sodium pyrophosphate, 1.0 gm. 5% $H_2O_2$ and 0.1 gm. cupric nitrate are added thereto with further agitation for about 1 minute. 0.05 gm. corn oil, 10 gm. Cooper's Creek Dark Neutral Oil (a coal derived oil available from Cooper's Creek Chemical Corp. West Conshohocken, Pa.) and 1 cc. of pine oil are added to the admixture and the admixture is permitted to react at ambient temperature and pressure for about 3 minutes. The resultant coal froth phase is removed with a strainer and the remaining aqueous phase is stirred. 0.034% by weight dry coal of Cooper's Creek Dark Neutral oil are added to the aqueous phase but no additional coal froth appeared. This aqueous phase is discarded.

The strained coal froth phase is again placed in the separatory funnel containing 5000 grams of clean water at 30° C. and agitated. 0.034%, by weight dry coal, of the Neutral oil and 0.034%, by weight dry coal, of pine oil are added and admixed therewith. The resultant coal froth is removed and the aqueous phase is discarded. The coal froth is again placed in the funnel containing 5000 grams of clean water at 30° C. and agitated. Another 0.034%, by weight dry coal, of Neutral oil and 0.034%, by weight dry coal, of pine oil are admixed therewith, and the resultant coal froth is removed. The aqueous phase is stirred and 0.034%, by weight dry coal, of Neutral oil and 0.034%, by weight dry coal, of pine oil are added thereto. A froth with coal floating within it is obtained and removed. Additional Neutral oil is added to the aqueous phase but no more coal floated. The water is discarded and the froth is filtered. The coal froth phases are combined and the following physical results are determined.

% recovery—25.6
% final ash—6.91
% final sulfur—0.83

EXAMPLE 3

200 grams of Indianhead lignite coal having an initial ash and sulfur content of 9.06% and 0.83% respectively, are ground for 15 minutes in the presence of 500 ml. water in a steel ball mill. The same procedure for coal beneificiation as employed in Example 2 is employed herein (except Flotation #634, available from Allied Chemical is used instead of the Neutral Oil) using the following ingredients:

$Na_4P_2O_7$—0.5 gm.
$H_2O_2$(5%)—1.0 gm.
$Cu(NO_3)_2$—0.1 gm.
Corn oil—0.05 gm.
Flotation Oil #634—10.252 gm.
Pine Oil—1.157 gms.

The following physical results of the resultant coal product are achieved:

% recovery—52.1%
% final ash—6.37%
% final sulfur—0.74%

Obviously, other modifications and variations of the present invention are possible in light of the above teachings. It is therefore to be understood that changes may be made in the particular embodiments of this invention which are within the full intended scope of the invention as defined by the appended claims.

We claim:

1. An improved process for the beneficiation of low rank coal, said process comprising the steps of:

(a) admixing pulverized low rank coal with a surface treating mixture comprised of water, a polymerizable monomer, a polymerization catalyst and a coal derived oil; and (b) recovering the resulting benef:ciated coal.

2. The process of claim 1 wherein said pulverized low rank coal is in an aqueous slurry.

3. The process of claim 1 wherein said low rank coal is selected from the group consisting of low rank bituminous, sub-butuminous, lignite and peat.

4. The process of claim 1 wherein said coal derived oil is utilized in an amount of from about 2 to about 3% by weight based on the weight of dry unbeneficiated coal.

5. The process according to claim 1 wherein said coal derived oil is selected from the group consisting of crude coal tar, tar acids, tar bases, naphtha, creosote, pitch and mixtures thereof.

6. The process according to claim 1 wherein said polymerizable monomer has the general formula $$RC(=O)-OR'$$

wherein R is an olefinically unsaturated organic radical and R' is selected from the group consisting of hydrogen, a salt forming cation, a saturated hydrocarbyl radical and an unsaturated hydrocarbyl radical, wherein said saturated or unsaturated hydrocarbyl radical is unsubstituted or substituted with one or more members selected from the group consisting of halogen, carboxylic acid group, hydroxyl and hydroxyl groups wherein the hydroxyl hydrogen atoms are replaced with saturated or unsaturated acyl groups or a combination of saturated and unsaturated acyl groups and said polymerization catalyst comprises a free radical catalyst and free radical initiator.

7. The process of claim 6 wherein said polymerizable monomer is corn oil.

8. The process of claim 6 wherein said polymerizable monomer is corn oil and said free radical catalyst comprises hydrogen peroxide and said free radical initiator comprises cupric nitrate.

9. The process of claim 2 wherein said pulverized coal-aqueous slurry contains a water conditioning agent selected from the group consisting of a dispersant, surfactant, wetting agent and mixtures thereof.

10. The process of claim 3 wherein said low rank coal is selected from the group consisting of lignite and subbituminous.

11. The process of claim 9 wherein said water conditioning agent is selected from the group consisting of sodium carbonate, sodium pyrophosphate, and mixtures thereof.

12. The process of claim 11 wherein said water conditioning agent is selected from the group consisting of sodium carbonate, sodium pyrophosphate and a mixture thereof.

13. The process of claim 1 wherein said surface treating mixture comprises a further liquid organic carrier.

14. The process of claim 13 wherein said liquid organic carrier is fuel oil.

15. An improved process for the beneficiation of low rank coal, said process comprising the steps of:

(a) admixing an aqueous slurry of pulverized low rank coal with a surface treating mixture comprised of a polymerizable monomer, a polymerization catalyst, and a coal derived oil, thereby resulting in a coal froth phase and an aqueous phase, (b) removing said coal froth phase from said aqueous phase and admixing said coal froth phase with an aqueous medium, thereby resulting in a further coal froth phase; and (c) recovering the resulting beneficiated coal product from the coal froth phase.

16. The process according to claim 15 wherein said aqueous medium of step (b) comprises water or water and a water conditioning additive selected from the group consisting of a dispersant, surfactant, wetting agent and mixtures thereof.

17. The process according to claim 15 wherein said aqueous medium of step (b) comprises water and an additional amount of coal derived oil.

18. The process of claim 15 wherein said polymerizable monomer is corn oil.

19. The process according to claim 15 wherein the coal froth phase resulting from step (b) is admixed with at least one other aqueous medium prior to recovering the beneficiated coal product.

* * * * *

UNITED STATES PATENT AND TRADEMARK OFFICE

CERTIFICATE OF CORRECTION

PATENT NO. : 4,583,990

DATED : April 22, 1986

INVENTOR(S) : McGarry, et al.

It is certified that error appears in the above-identified patent and that said Letters Patent is hereby corrected as shown below:

Column 3, Line 10, "socalled" should be --so-called--

Column 3, Line 10, "sifactorily" should be --isfactorily--

Column 3, Line 15, "be" should be --been--

Column 6, Line 5, "funiction" should be --function--

Column 8, Line 4, "os" should be --is--

Column 9, Line 54, "beneificiation" should be --beneficiation--

Signed and Sealed this

*Nineteenth* Day of *August 1986*

[SEAL]

*Attest:*

DONALD J. QUIGG

*Attesting Officer*

*Commissioner of Patents and Trademarks*